United States Patent [19]

Nestlen et al.

[11] Patent Number: 4,571,567

[45] Date of Patent: Feb. 18, 1986

[54] ELECTROMAGNETIC RELAY

[75] Inventors: Wolfgang Nestlen, Rottweil; Michael Scheffler, Wehingen, both of Fed. Rep. of Germany

[73] Assignee: Hengstler GmbH Geschaftsbereich, Haller-Relais, Wehingen, Fed. Rep. of Germany

[21] Appl. No.: 614,535

[22] Filed: May 29, 1984

[30] Foreign Application Priority Data

Jun. 1, 1983 [DE] Fed. Rep. of Germany ..... 3319927

[51] Int. Cl.[4] ..... H01H 51/06

[52] U.S. Cl. ..... 335/128; 335/135

[58] Field of Search ..... 335/128, 129, 133, 135, 335/132; 200/245, 246, 247

[56] References Cited

U.S. PATENT DOCUMENTS 3,701,062 10/1972 Koga et al. ..... 335/135

3,800,250 3/1974 Mori et al. ..... 335/135

*Primary Examiner*—Harold Broome

*Attorney, Agent, or Firm*—Paul H. Gallagher

[57] ABSTRACT

An electromagnetic relay especially such a relay with a spring jack, that serves for holding the magnet coil and the contact spring jump. In the simplest form of the relay, it includes the feature that the individual contact springs of the contact spring jump are provided with one piece fitted flat plugs, which are positioned in grooves in the ground wall of the spring jack, and in such position are securely fixed from the standpoint of strength and form.

8 Claims, 12 Drawing Figures

ELECTROMAGNETIC RELAY

The present invention concerns relays, expecially small relays, with a spring jack holding the magnet coil and the contact spring unit.

These days, relays are provided in mamy cases with flat plug juncture elements, which step enables relays of that sort to be easily inserted into readily available electrical circuits, or in case of a non-fit, can be exchanged.

With such relays that have flat plug juncture elements, there follows the bonding of the individual flat plugs with the juncture elements of the contact spring unit by means of conductors arranged inside the relay, which (conductors) must be fastened to the juncture elements of the flat plugs and the contact spring unit, for example, by means of soldering.

In view of this state of the techniques, it is the object of the present invention to make a relay, especially a small relay, which in comparison to the present separated, spacious means, possesses a starkly simplified assembly—in that the junction circuits to be laid separately inside the relay can be dispensed with.

According to the invention this is accomplished by providing the individual contact springs of the contact spring unit at the bottom with one-piece fitted flat plugs, which extend through grooves arranged in the ground wall of the spring jacks, and are securely fixed in position.

Advantageous further developments of the invention follow from the dependent claims.

The present invention is based on the realization that the contact spring unit of the relay in question can be modified in such a way that the conductor connectors of the contact spring unit normally provided in the interior of the relay, lie on the outside of the relay, in which case the pertinent conductor connectors can be immediately constructed in the form of flat plug connectors so that the junction circuits to be provided separately from inside the relay can be dispensed with. The position fixation of the contact spring unit with the one-piece fitted flat plugs results therefrom, inside of an adapter plate, which is attachable by means of ribs and rabbets at the ground wall of the spring jack of the pertinent relay. The extended adapter plate must thereby be so formed that both the flat plugs that lie on the outside of the relay, and the contact springs arranged on the inside of the relay are fixed in position. This element can be fixed in position either through spray imbedding, fluing fast, or shoving the contact spring unit into position with the flat plugs in the grooves in the adapter plate.

The grooves provided in the adapter plate, or conduit rabbets, as the case may be, are Z-form in shape, whereby on the one hand, a good position locking of the individual contact springs with their flat plugs results, while on the other hand, by maintaining a relatively minor distance between the individual contact springs, the distance between of the contact springs is enlarged, which in view of the necessary insulation qualities, appears in many ways desirable oreven necessary. To the further enlargement of the existing space there exists also the possibility that on the outside of the adapter plate, additional ribs or rabbets are provided which run between the individual flat plugs. The adapter plate is finally also so formed that in response to its being put in place, fastening of the relay inside an electric connector is possible.

The invention is now described in detail and illustrated by specific structures in the accompanying drawings:

Figure 1:
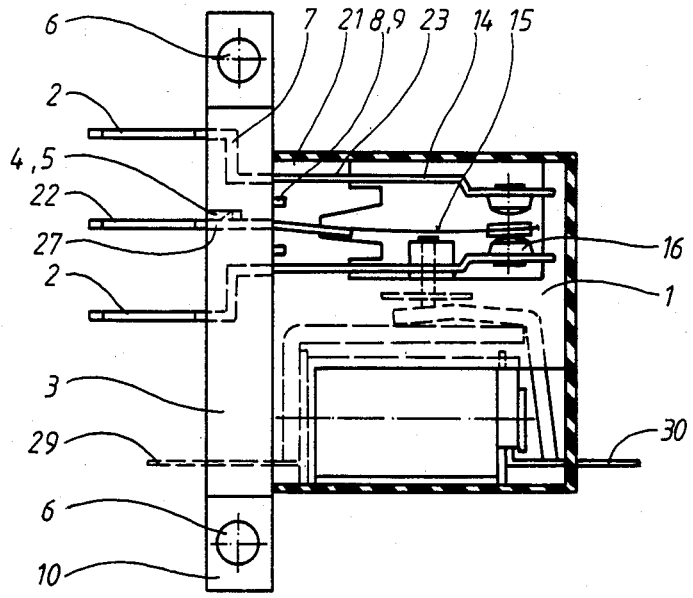
FIG. 1—a side view, partially in cross-section, of a first construction form of the small relay made according to the invention, FIGS. 2 and 3—respectively a side and front view of the small relay of FIG. 1, FIGS. 4–6—different views of the adapter plate of the small relay from FIG. 1, FIGS. 7–9—schematic cross sectional views of different forms of adapter plates, and the contact spring unit separated therefrom, respectively, FIG. 10—a schematic, perspective view of a variant form of adapter plate for the holding of a spring contact unit, and FIGS. 11 and 12—a front view and side view of a further form of adapter plate for holding or respective positioning of a spring contact unit.
Figure 2:
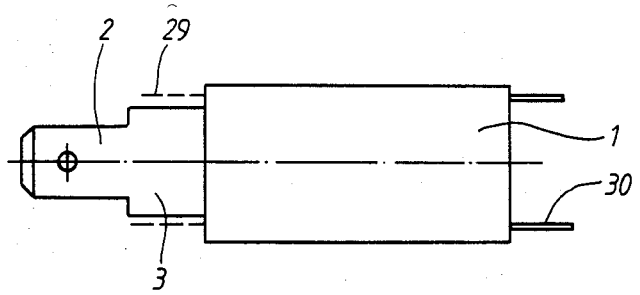
Figure 3:
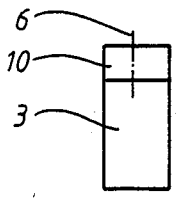

The small relay 1 shown in FIGS. 1–3 contains an actuating unit whose coil can be closed through connectors 29, 30. The anchor works on a contact spring unit which consists of three contact springs 14–16. These contact springs 14–16 are of one-piece construction, with flat plugs 2, 22 that project out of the ground surface of the relay. The contact springs 14–16 lead thereby through grooves 23 of a spring jack 21 and are fixed in position with straight or Z-form, grooves 7, 27 of an adapter plate 3. By reason of this construction of the adapter plate 3, the force in connecting the flat plugs 2, 22, does not move those plugs to the spring jack 3, nor move the contact springs 14–16. This is accomplished by, for example, a large lobe 4 provided on the middle flat plug 22 which enters into a corresponding notch 5 in the region of the conduit rabbet 27. The outer contact springs 14, 16 includes the construction that the corresponding rabbet 7 of the adapter plate 3, and the flat plug 2 therein, are constructed Z-form, effectively holding the contact springs.

In direction perpendicular to the plane of the drawing of FIG. 1, the adapter plate 3 can be pushed up to the spring jack 21 of the small relay 1. The sure-form binding of the adapter plate 3 with the ground surface of the spring jack 21, includes, on the side of the adaptor plate 3 that is turned toward the ground surface, projecting ribs are provided that grip into corresponding rabbets 3 at the ground surface of the spring jack 21.

At both ends of the adapter plate 3 are provided additional added pieces 10 with bores 6, through which fastening means, not shown, lead, with which the adapter plate 3 can be fastened to a desired fastening surface.

Figure 4:
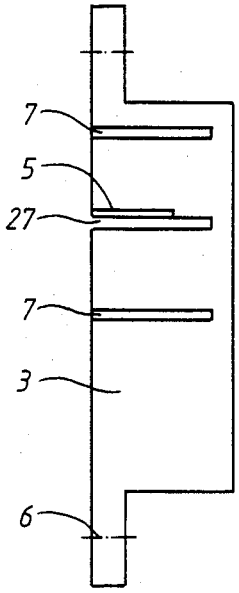
Figure 5:
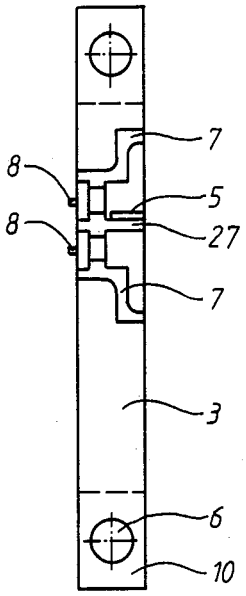
Figure 6:
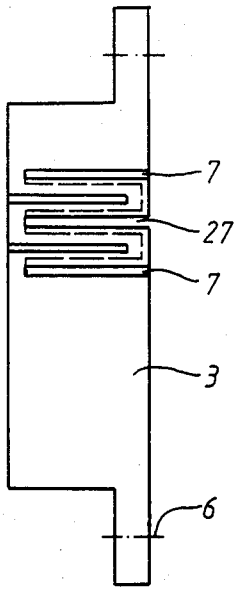

FIGS. 4–6 show further characteristics of the adapter plate 3. It can be seen from these figures that the grooves that function as conduit rabbets 7 are of Z-form, while the conduit rabbet 27 is straight. In the region of the spring rabbet 7, 27 is a notch spring 5, in which the respective flat plug 2, 22 notches with, by means of lobes 4 projecting therefrom.

Figure 7:
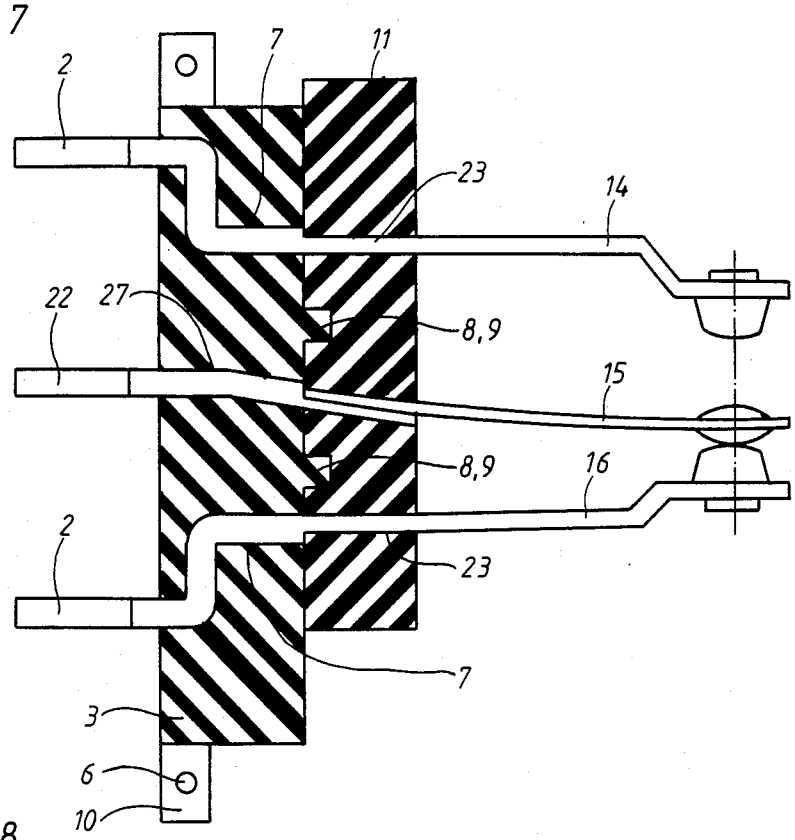

FIG. 7 shows in schematic, enlarged presentation, the manner of fastening the adapter plate 3 on the contact springs 14–16 provided with flat plugs 2, 22. This figure shows prominent ribs 8 on the rear side of the adapter plate 3, which enter into corresponding rabbets 9 in the spring jack 11 of the relay 1. From this it is clear that the contact springs 14–16 are always removable from the grooves 23 of the spring jack 11 and can be exchanged for contact springs of another form.

Figure 8:
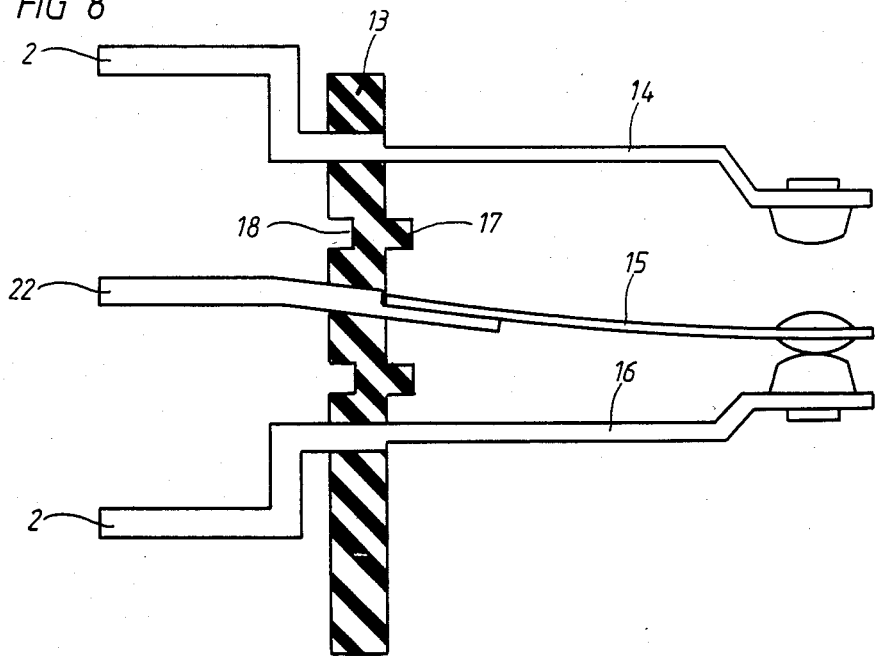

In the form shown in FIG. 8, the adapter plate 13 shows on the one side, rabbets 18, whose longitudinal stretch runs parallel to the broadside of the flat plugs 2, 22 so that between the flat plugs, spaces of greater length are formed. Lying opposite the rabbets 18 are ribs 17 formed of the material of the adapter plate 13 which enter into rabbets, not shown in detail, in the spring jack of the relay 1. Furthermore, in this form, the contact springs 14–16, with their flat plugs 2, 22, are imbedded in the material of the adapter plate 13, that is, inseparably bound with the adapter plate 13. Instead of imbedding the adapter plate 13 in synthetic material, the contact springs 14–16 with their flat plugs 2, 22 can be secured by gluing.

Figure 9:
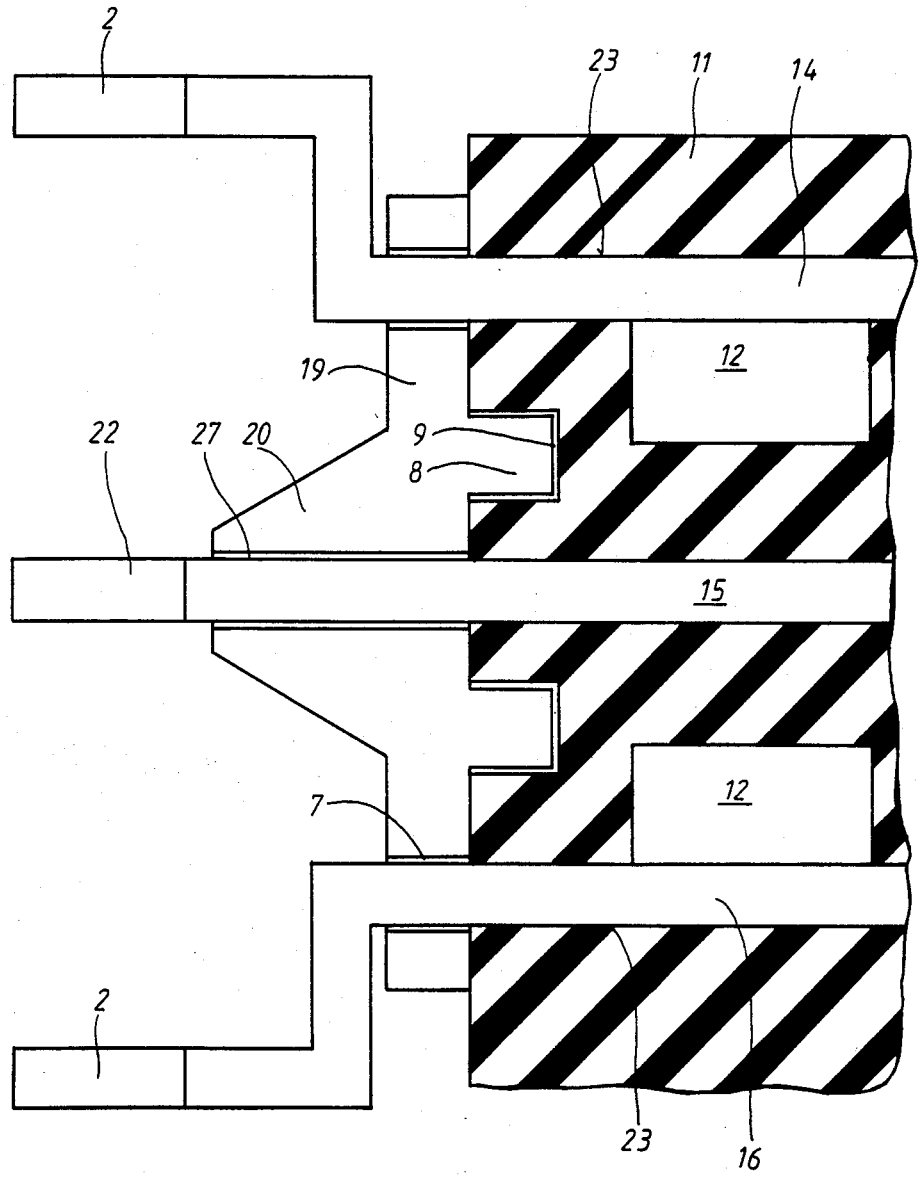

In the form of FIG. 9, is an adapter plate 19, by which the middle conduit rabbet 27 is axially lengthened, that it extends through the body of a wedge-form support 20 of the adapter plate 19.

It is further seen that the contact springs 14 and 16 are provided with lobes 12 which notch into the material of the spring jack 21, this providing additional security of positioning the contact springs 14–16 in the grooves 23.

Figure 10:
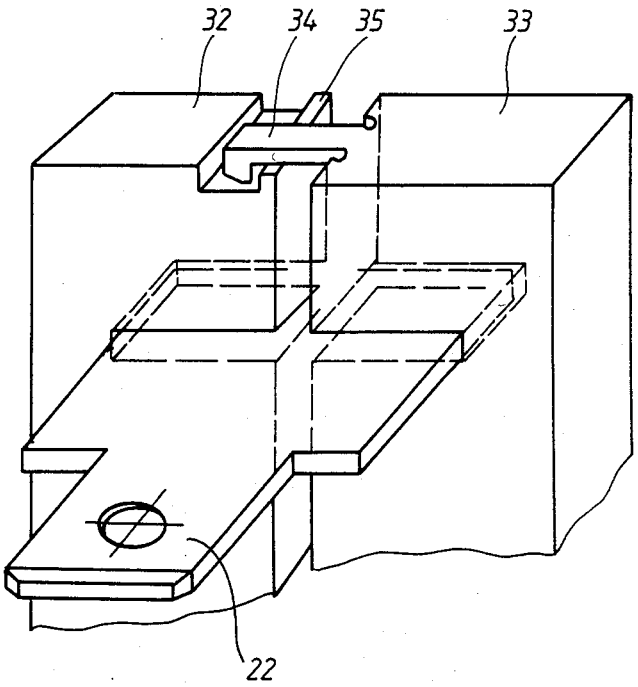

FIG. 10 shows in perspective schematic view, a further form of an adapter plate 31, which in this case consists of two plates 32, 33, which by means of corresponding notch elements 34, 35, can be bound together by snapping them together.

By means of the parts 32, 33 of the adapter plate 31, the individual flat plugs with their fitted contact springs (for example flat plug 22) can be securely held inside of the adapter plate 31, whereby the flat plug is surrounded on all sides, so that flat plug is fixed as securely as possible.

Figure 11:
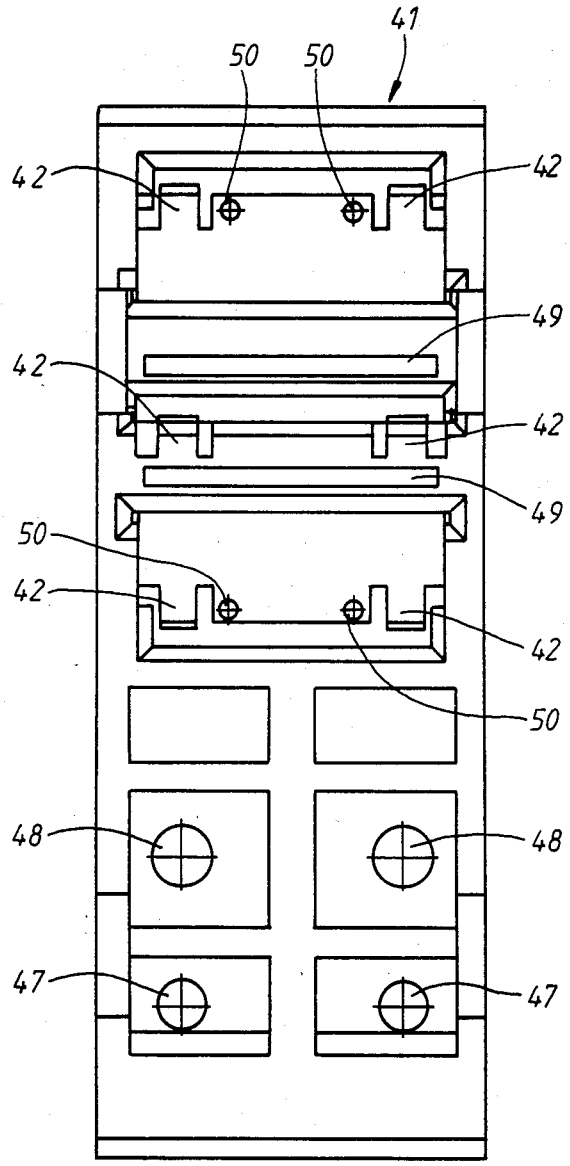
Figure 12:
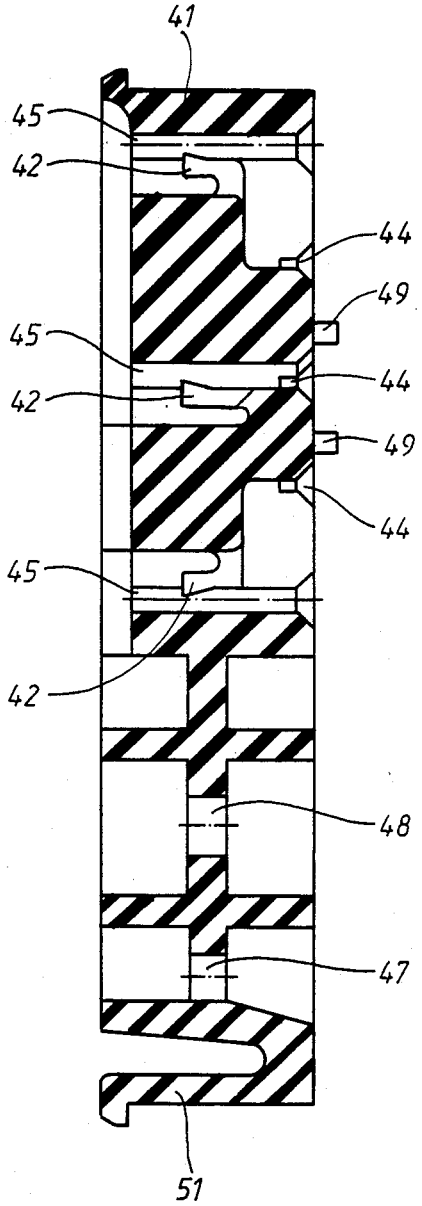

FIGS. 11 and 12 show a further form of an adapter plate 41 within the scope of the present invention, this adapter plate being so constructed that it can be fixed, from underneath, to the small relay 1 provided with the flat plugs 2, 22. The individual flat plugs 2, 22 are thereby completely surrounded by the adapter plate 41, providing an excellent insulation of the individual flat plugs 2, 22.

With the corresponding adapter plate 41 there are likewise provided, in agreement with the form in FIG. 1, Z-form conduit rabbets, or conduit grooves, in which both the outer flat plugs 2 lie. In FIG. 12 the entrances of the conduit rabbets are indicated at 44, and the exits thereof at 45.

In order to fixedly secure the individual flat plugs 2, 22, in position in the adapter plate 41, noses 42 are provided within the conduit rabbets on both sides, which, in pushing the adapter plate 41 on to the flat plug 2, 22, notch into corresponding lateral recesses on the flat plugs 2, 22.

Within the Z-form conduit rabbet, the adapter plate 41 is provided with additional point impression 50 on which the angled regions of the flat plugs 2 lie, accurately positioning the flat plug 2 in relation to the adapter plate 41.

The adapter plate 41 presented in FIGS. 11 and 12 indicate, in their under regions, entry openings 47 and 48 arranged in pairs, whereby the entry openings 47 serve for the leading through of the coil connections and the entry openings 48 for the leading through of the surrounding connection.

Finally, the adapter plate 41 is also provided with additional ribs 49 and a notch lobe 51, whereby the ribs 49 provide an enlargement of the crawl spaces that arise between the individual flat plugs 2, 22, while the notch lobes 11 allow fastening of the adapter plate 41, with the small relay 1 attached thereto, inside of an electrical instrument.

We claim:

1. A miniature relay comprising, a first component including a magnetic coil and a spring set operably associated therewith, the spring set including a plurality of contact springs at least certain ones of which are flexed in a switching operation by actuation of the coil, a second component mounted to the first component, in which the contact springs are securely and fixedly mounted at one end of the contact springs, with their other ends extended in an inner direction for flexing by actuation of the coil, said second component including a spring mount and an adapter plate formed as separate pieces and detachably secured together as a unit, and having interlocking elements locating them in a predetermined position in transverse directions, the contact springs having plug elements extending in an outer direction from the second component, and the contact springs and the second component respectively having positive interengaging elements for preventing movement of the contact springs in said inner direction in response to force in that direction against the plug elements, the interengaging elements in the second component being formed respectively on the spring mount and adapter plate.

2. A miniature relay according to claim 1 wherein, the contact springs are mounted in the second component by embedding at least the plug elements thereof in the adapter plate.

3. A miniature relay according to claim 1 wherein, the adapter plate is provided with leader grooves opening on one side of the adapter plate, whereby the plug elements, and contact springs, are insertable into the leader grooves, and thereby into the adapter plate from the side.

4. A miniature relay according to claim 1 wherein, the adapter plate is made up of a pair of side-by-side parts having interfacing notches that form holes when the parts are fitted together receiving the plug elements and thereby mounting the contact springs in the adapter plate.

5. A miniature relay according to claim 1 wherein, the plug elements, and the passages in the adapter plate in which they are embedded, are Z-shape as viewed transverse to the inner/outer direction.

6. A miniature relay according to claim 1 wherein, at least one of the contact springs, with the plug element thereof is closely adjacent straight shape, and the contact spring and the passage in the adapter plate in which it is mounted have respectively positive/negative formations interengaging and thereby preventing said movement of the contact springs.

7. A miniature relay according to claim 1 wherein, the adapter plate on the side thereof facing said outer direction is provided with indentations producing increased crawl space between the plug elements.

8. A miniature relay according to claim 1 wherein, the adapter plate at its ends as determined in direction of the spacing of the plug elements, includes bores for securing additional members for thereby mounting the relay.

* * * * *